US009375604B2

(12) United States Patent
Yeh

(10) Patent No.: US 9,375,604 B2
(45) Date of Patent: Jun. 28, 2016

(54) ADJUSTABLE PEDAL ASSEMBLY FOR FITNESS MACHINE

(71) Applicant: PROTEUS SPORTS INC., New Taipei (TW)

(72) Inventor: Cheng-Chen Yeh, New Taipei (TW)

(73) Assignee: PROTEUS SPORTS INC., New Taipei (TW)

( * ) Notice: Subject to any disclaimer, the term of this patent is extended or adjusted under 35 U.S.C. 154(b) by 0 days.

(21) Appl. No.: 14/591,326

(22) Filed: Jan. 7, 2015

(65) Prior Publication Data

US 2015/0297943 A1 Oct. 22, 2015

(30) Foreign Application Priority Data

Apr. 21, 2014 (TW) ..... 103206894 U

(51) Int. Cl.
*A63B 22/06* (2006.01)
*A63B 22/00* (2006.01)

(52) U.S. Cl.
CPC ..... *A63B 22/0046* (2013.01); *A63B 22/06* (2013.01); *A63B 22/0076* (2013.01); *A63B 2225/09* (2013.01)

(58) Field of Classification Search
CPC ..... A63B 22/06; A63B 22/0046; A63B 22/0076; Y10T 74/20918; Y10T 74/20888; Y10T 74/20528; Y10T 74/209; Y10T 74/20906
See application file for complete search history.

(56) References Cited

U.S. PATENT DOCUMENTS 1,920,574 A * 8/1933 Luzzi ..... A63B 22/0076 482/72
4,114,613 A * 9/1978 Kuhn ..... A63B 23/0211 482/79
5,072,929 A * 12/1991 Peterson ..... A63B 22/0076 310/105

* cited by examiner

*Primary Examiner* — Thomas Diaz
(74) *Attorney, Agent, or Firm* — Muncy, Geissler, Olds & Lowe, P.C.

(57) ABSTRACT

An adjustable pedal assembly for use in a fitness machine is disclosed to include a pedal holder frame including two lateral plates, two guide axles connected in parallel between the lateral plates and a mounting unit for mounting on the fitness machine, two pedals slidably supported on the guide axles of the pedal holder frame, and an adjustment device including an actuation member inserted through and connected with the pedals and rotatable to move the pedals relative to each other, and a rotary adjustment knob fastened to one end of the actuation member and operable to rotate the actuation member in adjusting the transverse distance between the two pedals.

2 Claims, 6 Drawing Sheets

ADJUSTABLE PEDAL ASSEMBLY FOR FITNESS MACHINE

This application claims the priority benefit of Taiwan patent application number 103206894, filed on Apr. 21, 2014.

BACKGROUND OF THE INVENTION

1. Field of the Invention

The present invention relates to fitness machine technology and more particularly, to an adjustable pedal assembly for fitness machine which allows adjustment of the pitch between the two pedals thereof.

2. Description of the Related Art

Fitness has become an increasingly popular sport in today's modern society. In order to improve the efficiency of fitness, so many people will use a fitness machine to assist exercises. However, most people overlook the possibility that using a fitness machine in an incorrect posture not only cannot well train the muscles, but also easily lead to joint wear or sports injuries such as muscle strain.

FIG. 1 illustrates a conventional fitness machine. This design of fitness machine comprises an elongated base frame 10, an operating member 11 mounted at a front side of the elongated base frame 10, a seat 12 slidably adjustably supported on the elongated base frame 10, and two pedals 13,14 bilaterally mounted at the elongated base frame 10 between the operating member 11 and the seat 12. In application, the user is sitting on the seat 12 with the feet of the legs rested on the pedals 13,14 and the hands holding the operating member 11, and then pulling the operating member 11 in direction toward the chest and then releasing the pulling force from the operating member 11 without leaving the hands from the operating member 11, and then repeating this operating cycle again and again.

Because different users have different body sizes, every user must adjust the fitness machine for best fit before exercise. However, this conventional fitness machine simply allows the user to adjust the distance between the seat 12 and the pedals 13,14 but not allows adjustment of the transverse distance between the two pedals 13,14 to match with the distance between the feet of the user's two legs. Thus, this prior art design of fitness machine is still not very easy to use, and even can affect exercising safety.

SUMMARY OF THE INVENTION

The present invention has been accomplished under the circumstances in view. It is therefore the main object of the present invention to provide an adjustable pedal assembly for fitness machine, which allows adjustment of the transverse distance between the two pedals thereof to fit different users.

To achieve this and other objects of the present invention, an adjustable pedal assembly for fitness machine in accordance with the present invention comprises a pedal holder frame, two pedals, and an adjustment device. The pedal holder frame comprises two lateral plates, two guide axles connected in parallel between the two lateral plates, and a mounting unit for mounting on a fitness machine. The two pedals are slidably supported on the guide axles, each comprising a footplate and two structural walls respectively formed integral with two opposite lateral sides of the footplate and slidably coupled to the guide axles. The adjustment device comprises an actuation member inserted through and connected with the two pedals and rotatable to move the two pedals relative to each other, and a rotary adjustment knob fastened to one end of the actuation member and operable to rotate the actuation member.

Thus, by means of slidably coupling the pedals to the guide axles of the pedal holder frame and using the adjustment device to couple the pedals, the user can operate the adjustment device to move the two pedals on the guide axles in direction toward or away from each other. Thus, the transverse distance between the two petals can be conveniently and accurately adjusted to best fit the distance between the user's two legs, enabling the user to operate the fitness machine accurately and safely.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
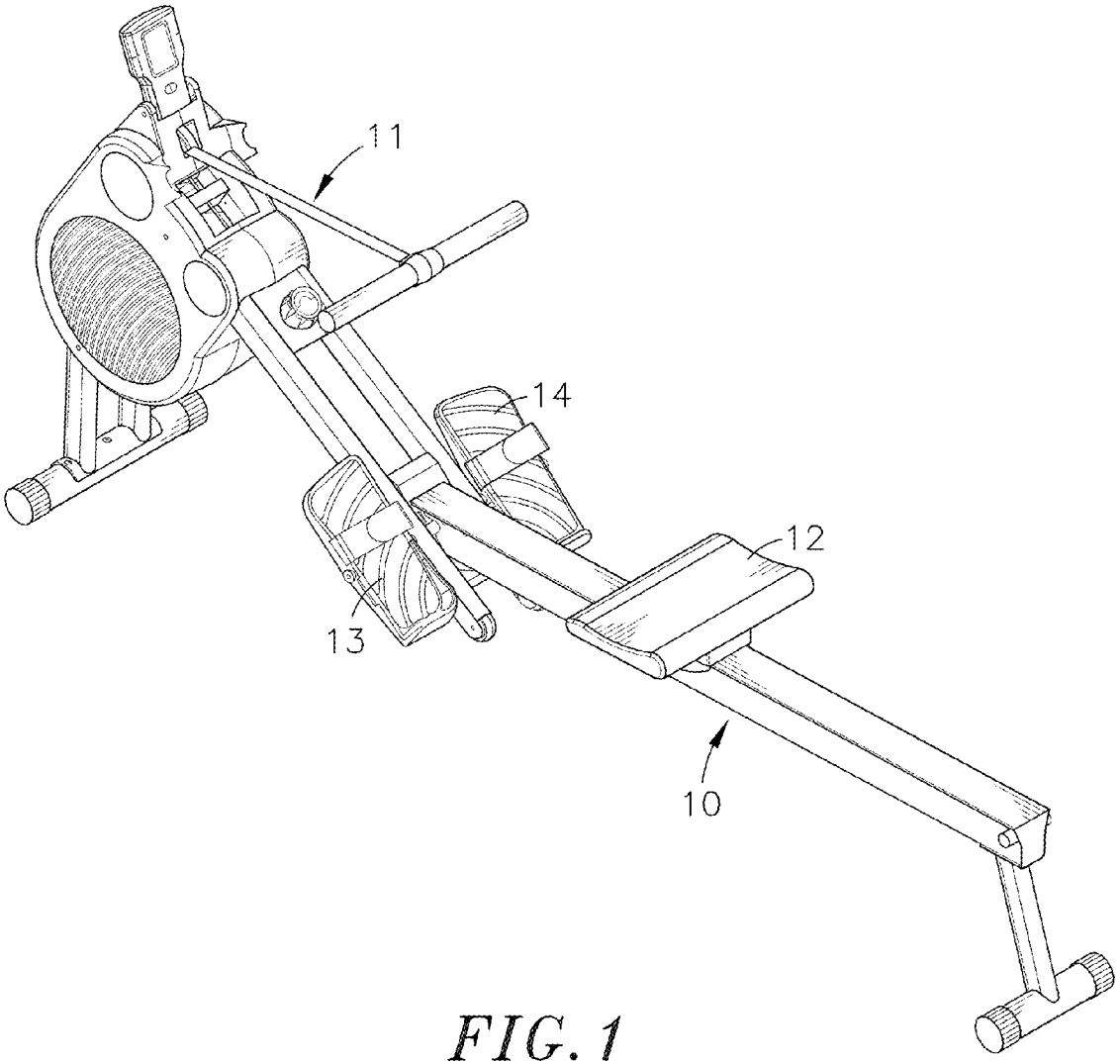
FIG. 1 is an oblique top elevational view of a fitness machine according to the prior art.
Figure 2:
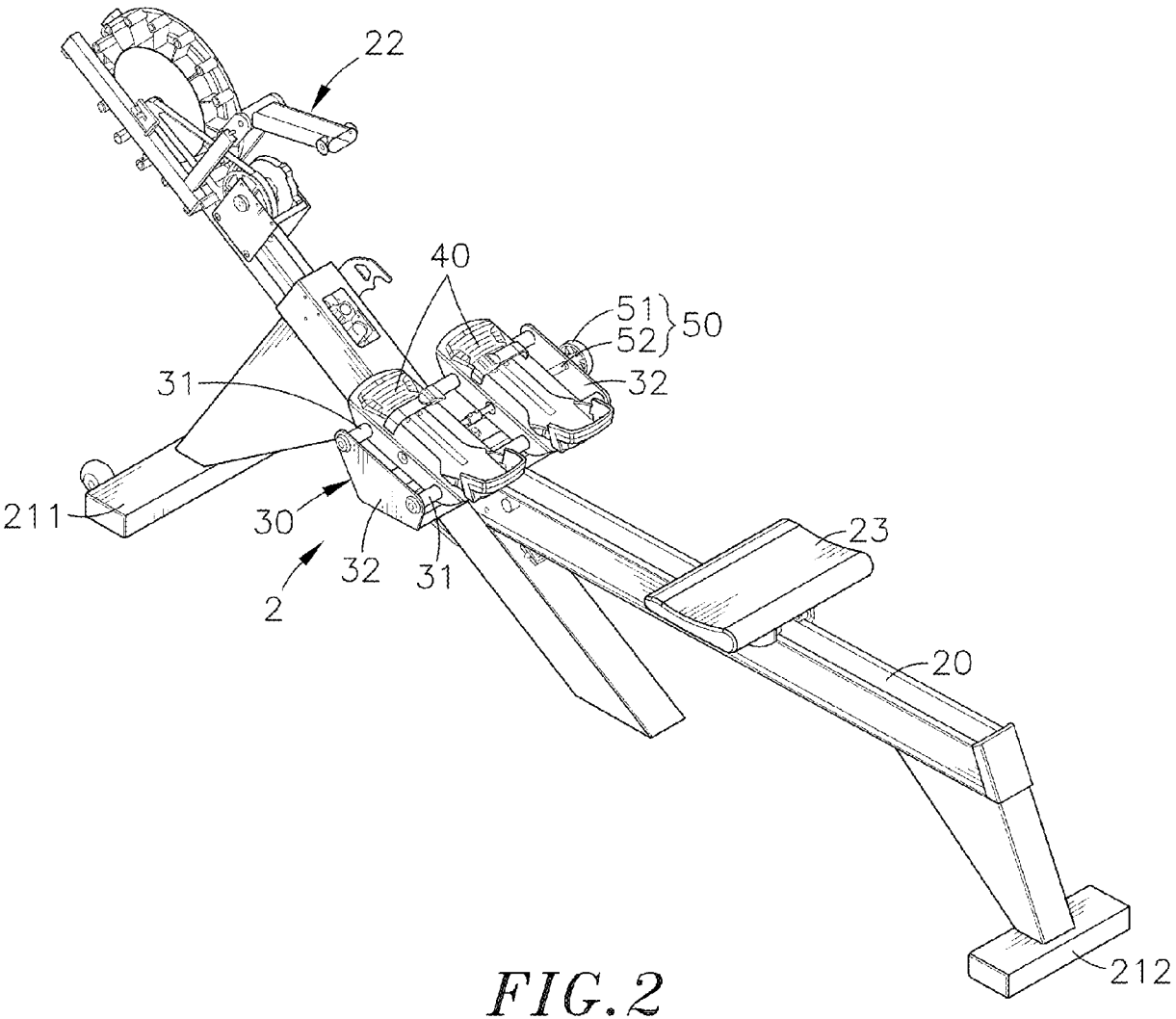
FIG. 2 is an oblique top elevational view of a fitness machine with an adjustable pedal assembly in accordance with the present invention.
Figure 3:
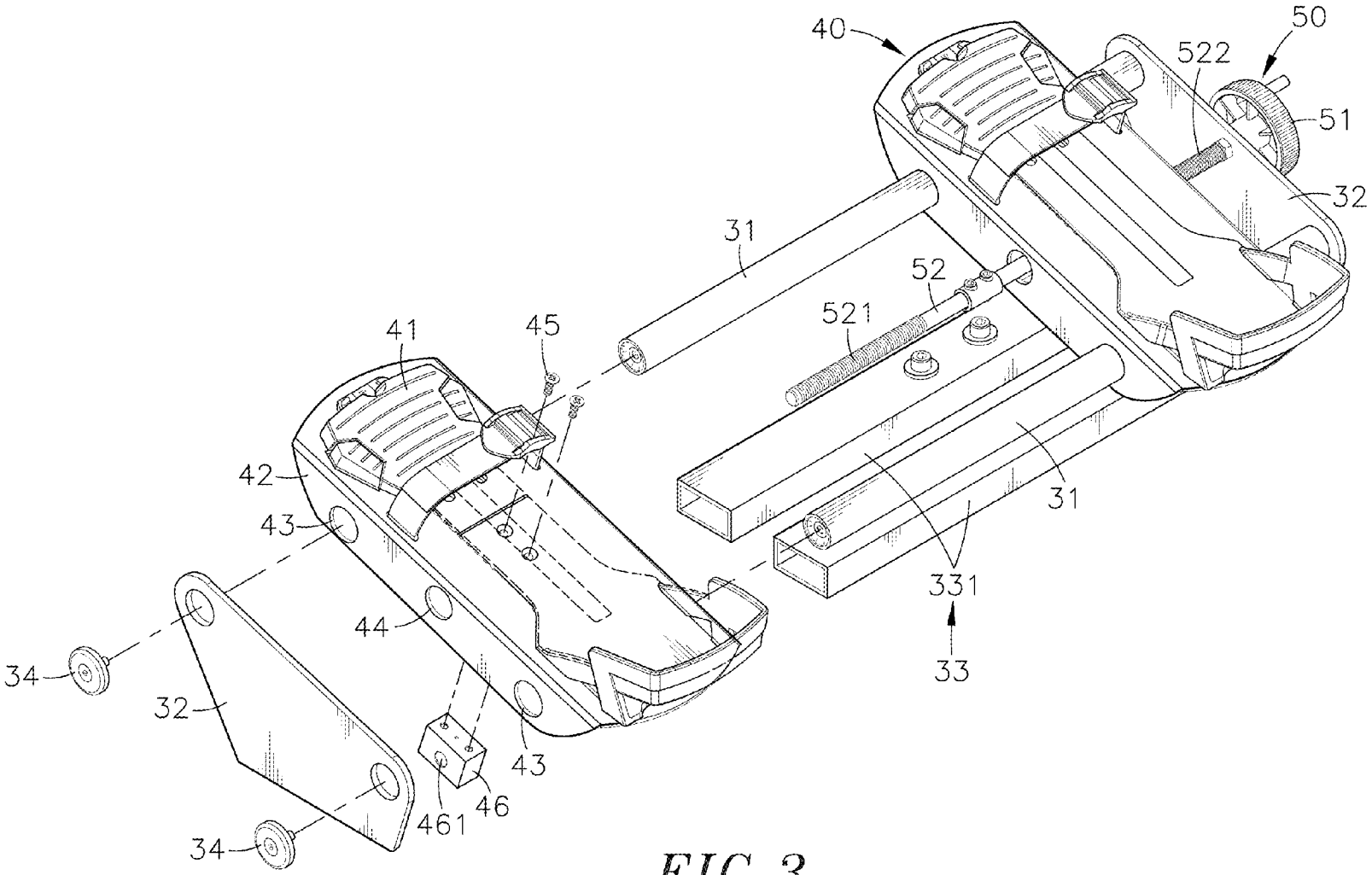
FIG. 3 is an exploded view, in an enlarged scale, of the adjustable pedal assembly shown in FIG. 2.
Figure 4:
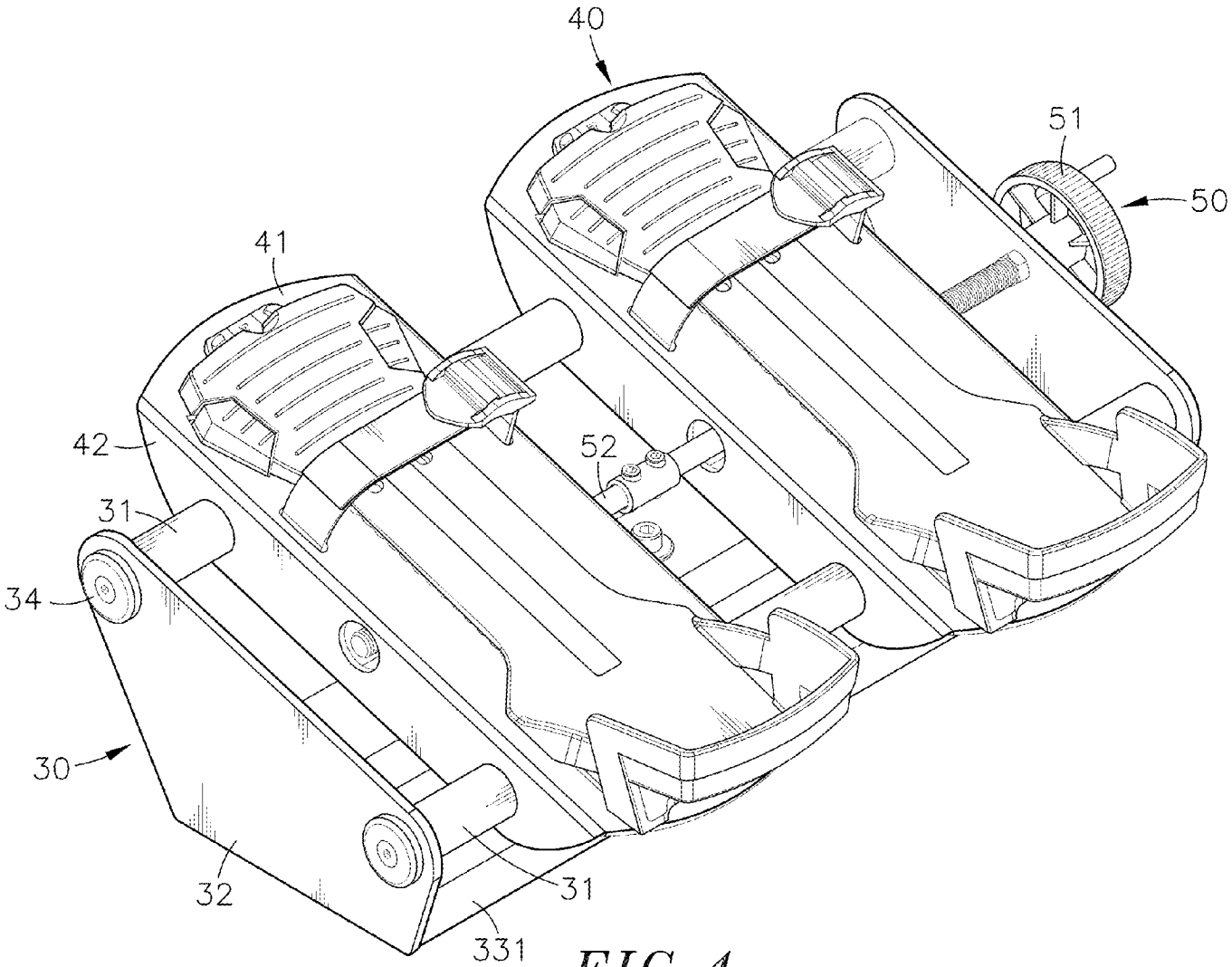
FIG. 4 is an assembly view of the adjustable pedal assembly shown in FIG. 3.

Referring to FIGS. 2-4, an adjustable pedal assembly for fitness machine in accordance with the present invention is shown used in a fitness machine 2. The fitness machine 2 comprises an elongated base frame 20 having opposing front foot member 211 and rear foot member 212 for positioning on the floor, an operating member 22 mounted at a front side of the elongated base frame 20, and a seat 23 slidably adjustably supported on the elongated base frame 20. Because the seat 23 is slidably adjustably supported on the elongated base frame 20, a user can adjust the distance between the operating member 22 and the seat 23. The adjustable pedal assembly comprises a pedal holder frame 30, two pedals 40, and an adjustment device 50.

The pedal holder frame 30 comprises two lateral plates 32 arranged at two opposite lateral sides, two guide axles 31 connected between the two lateral plates 32 in a parallel relationship and fixedly secured thereto with fastening members 34, and a mounting unit 33 affixed to the lateral plates 32 below the guide axles 31 and adapted for fastening the pedal holder frame 30 to the fitness machine 2. Preferably, the mounting unit 33 comprises two rectangular frame bars 331 fixedly connected between the two lateral plates 32. By means of the two rectangular frame bars 331, the pedal holder frame 30 can be affixed to the elongated base frame 20 of the fitness machine 2 at a location between the operating member 22 and the seat 23.

The two pedals 40 each comprise a footplate 41, two structural walls 42 respectively formed integral with two opposite lateral sides of the footplate 41 and slidably coupled to the guide axles 31 to let the footplate 41 be movably supported on the guide axles 31, and a connection block 46 fixedly fastened to a bottom surface of the footplate 41 by screws 45. In more detail, each structural wall 42 has two coupling holes 43 respectively coupled to the guide axles 31, and a through hole 44 spaced between the coupling holes 43. Further, the connection block 46 has an adjustment screw hole 461.

The adjustment device 50 comprises a rotary adjustment knob 51 and an actuation member 52 fixedly connected to and rotatable with the rotary adjustment knob 51. The actuation member 52 is inserted through and connected with the pedals 40 is such a manner that rotating the rotary adjustment knob 51 in a clockwise or counter-clockwise direction causes the actuation member 52 to move the two pedals 40 along the guide axles 31 in direction toward or away from each other. In this embodiment, the actuation member 52 is a screw rod inserted through the through holes 44 of the structural walls 42 of the pedals 40, comprising two reversed threads 521,522 respectively threaded into the adjustment screw holes 461 of the connection blocks 46.

After understanding of the configuration of the related component parts of the adjustable pedal assembly and their relationship, the operation and effects of the adjustable pedal assembly are outlined hereinafter. As illustrated in FIG. 2, in application, the user is sitting on the seat 23 with the feet of the legs rested on the pedals 40 and the hands holding the operating member 22, and then operating the hands to pull the operating member 22 in direction toward the chest and then releasing the pulling force from the operating member 22 without leaving the hands from the operating member 22, and then repeating this operating cycle again and again.

Figure 5:
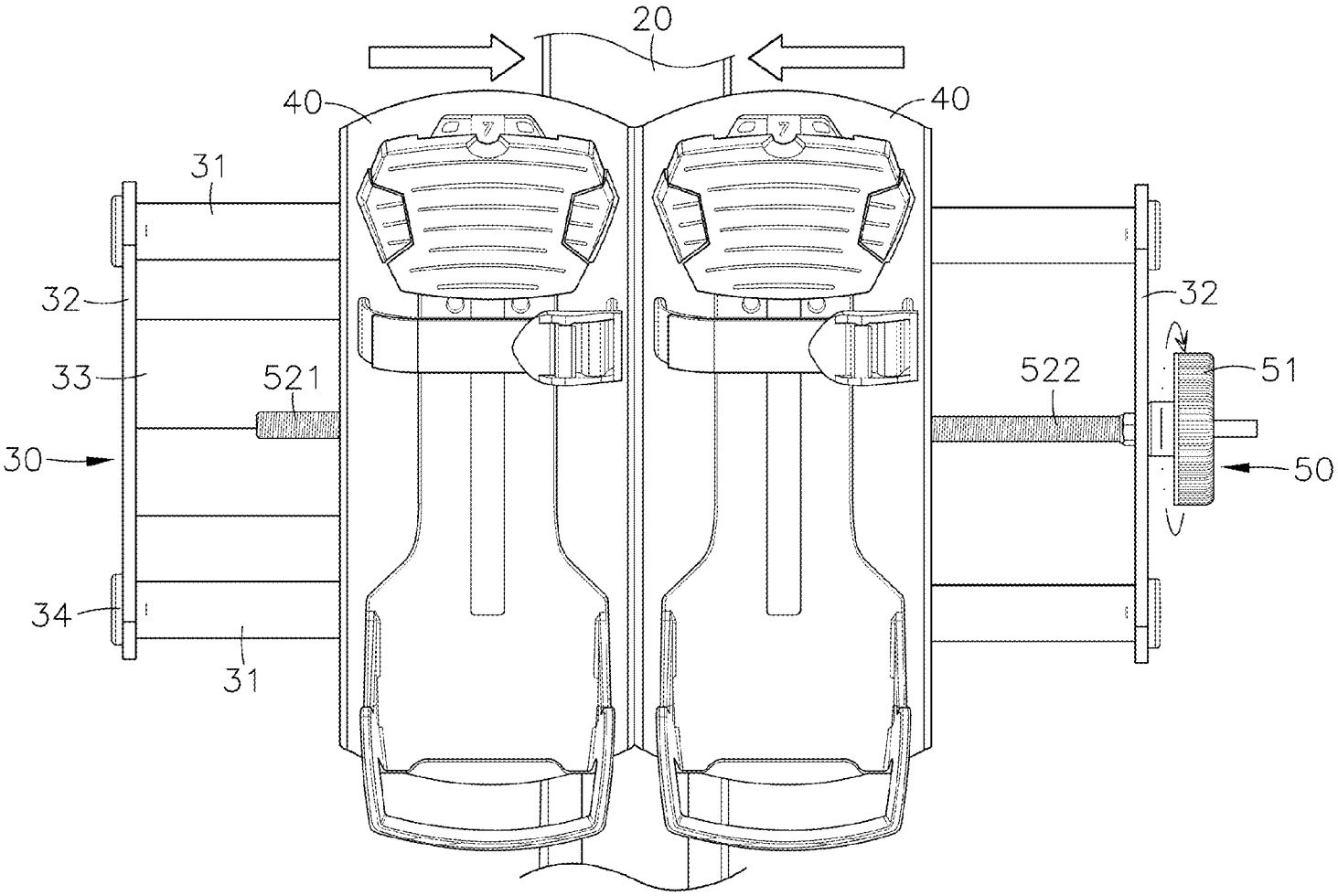
FIG. 5 is a schematic applied view of the present invention, illustrating the two pedals adjusted and abutted against each other.
Figure 6:
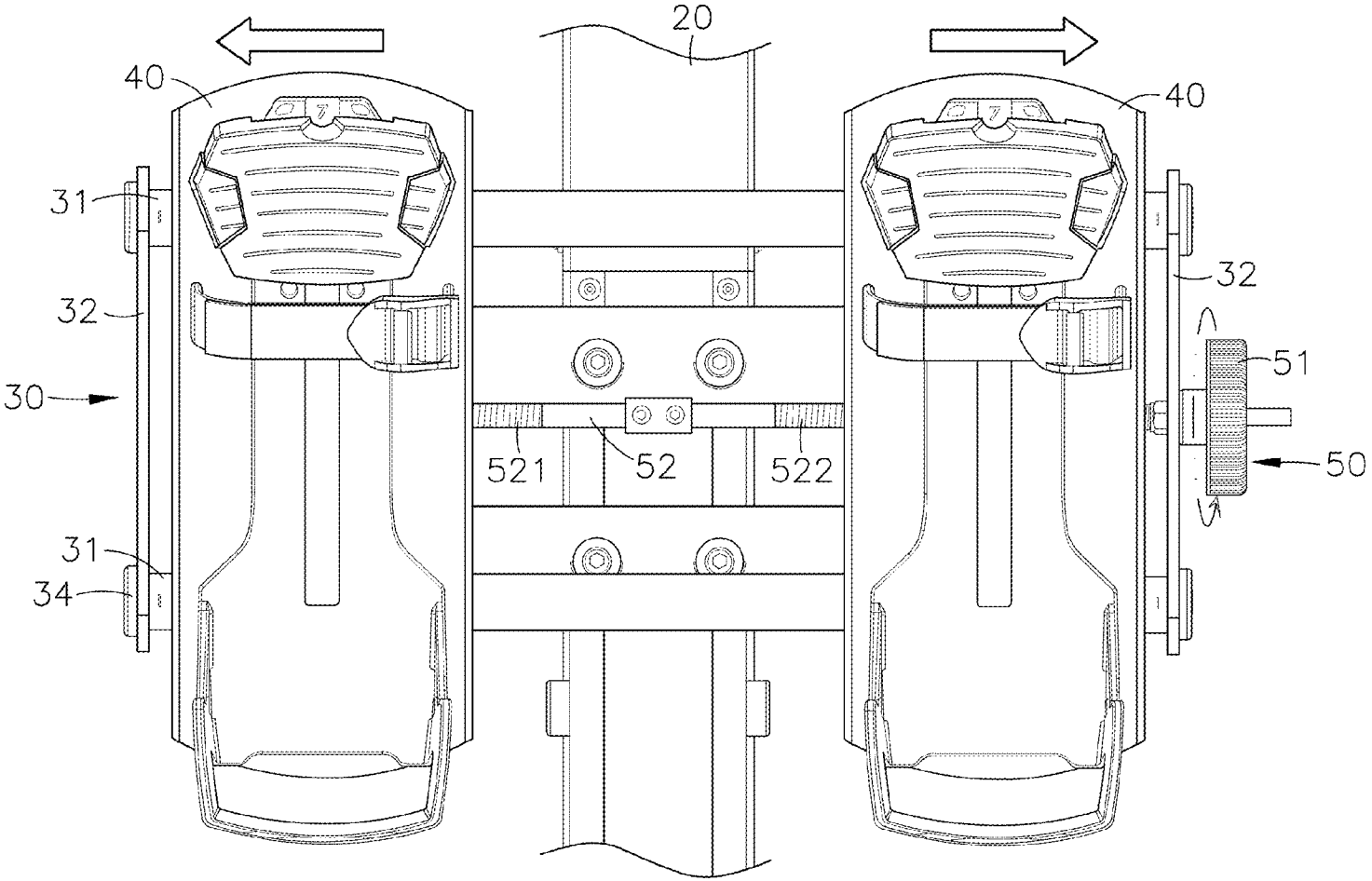
FIG. 6 is a schematic applied view of the present invention, illustrating the two pedals adjusted and moved in direction away from each other.

Referring to FIGS. 5 and 6 and FIGS. 2-4 again, when wishing to adjust the transverse distance between the two pedals 40, operate the rotary adjustment knob 51 of the adjustment device 50 to rotate the actuation member 52. Because the threads 521,522 extend in reversed directions and are respectively threaded into the adjustment screw holes 461 of the connection blocks 46, the two pedals 40 are moved in direction toward or apart from each other as the user operates the rotary adjustment knob 51 to rotate the actuation member 52 clockwise or counter-clockwise. Thus, the transverse distance between the two petals 40 can be conveniently and accurately adjusted to best fit the distance between the user's two legs, enabling the user to operate the fitness machine 2 comfortably and safely.

Although a particular embodiment of the invention has been described in detail for purposes of illustration, various modifications and enhancements may be made without departing from the spirit and scope of the invention. For example, the adjustment device can be a gear-rack mechanism comprising two toothed racks disposed at different elevations and respectively connected to the pedals, a gear meshed between the two toothed racks, and a rotary adjustment knob operable to rotate the gear. In another alternate form, the adjustment device comprises a four-bar linkage having two opposing links thereof respectively pivotally coupled to the two pedals, a screw rod threaded through the other two opposing links of the four-bar linkage, and a rotary adjustment knob affixed to one end of the screw rod and operable to rotate the screw rod. This alternate form can also be conveniently operated to adjust the transverse distance between the two pedals.

What the invention claimed is:

1. An adjustable pedal assembly for fitness machine, comprising:

a pedal holder frame comprising two lateral plates, two guide axles connected in parallel between said two lateral plates, and a mounting unit for mounting on a fitness machine;

two pedals slidably supported on said guide axles, each said pedal comprising a footplate, and two structural walls respectively formed integral with two opposite lateral sides of said footplate and slidably coupled to said guide axles; and an adjustment device comprising an actuation member inserted through and connected with said two pedals and rotatable to move said two pedals relative to each other, and a rotary adjustment knob fastened to one end of said actuation member and operable to rotate said actuation member, wherein said actuation member is a screw rod having two threads extending around two opposite ends thereof in reversed directions and each said pedal further comprises a connection block fixedly mounted at a bottom side of the footplate thereof, said connection block comprising an adjustment screw hole threaded onto one said thread of said actuation member.

2. The adjustable pedal assembly for fitness machine as claimed in claim 1, wherein said mounting unit comprises two rectangular frame bars fixedly connected between said two lateral plates at an elevation below said guide axles.

* * * * *